United States Patent [19]

Terasawa et al.

[11] Patent Number: 4,970,534

[45] Date of Patent: Nov. 13, 1990

[54] INK JET RECOVERY DEVICE HAVING A SPRING-LOADED CAP AND A MECHANISM FOR PRESSING THE CAP AGAINST A RECORDING HEAD AND APPARATUS INCORPORATING THE DEVICE

[75] Inventors: Koji Terasawa; Akira Miyakawa, both of Tokyo; Hideki Yamaguchi, Yokohama, all of Japan

[73] Assignee: Canon Kabushiki Kaisha, Tokyo, Japan

[21] Appl. No.: 357,303

[22] Filed: May 26, 1989

Related U.S. Application Data

[63] Continuation of Ser. No. 77,879, Jul. 27, 1989.

[30] Foreign Application Priority Data

Aug. 5, 1986 [JP] Japan ..... 61-182740

[51] Int. Cl.[5] ..... B41J 2/165

[52] U.S. Cl. ..... 346/140 R

[58] Field of Search ..... 346/140

[56] References Cited

U.S. PATENT DOCUMENTS

| | | | |
|---|---|---|---|
| 4,403,233 | 9/1983 | Terasawa et al. | 346/140 R |
| 4,410,900 | 10/1983 | Terasawa | 346/140 |
| 4,492,969 | 1/1985 | Terasawa | 346/140 R |
| 4,493,993 | 1/1985 | Kanamuller | 346/140 X |
| 4,506,277 | 3/1985 | Terasawa | 346/140 R |
| 4,509,057 | 4/1985 | Sohl | 346/140 X |
| 4,510,510 | 4/1985 | Terasawa | 346/140 |
| 4,518,973 | 5/1985 | Tazaki | 346/140 R |
| 4,543,589 | 9/1985 | Terasawa | 346/140 R |
| 4,543,591 | 9/1985 | Terasawa | 346/140 |
| 4,551,735 | 11/1985 | Suzuki | 346/140 |
| 4,577,203 | 3/1986 | Kawamura | 346/140 R |
| 4,631,556 | 12/1986 | Watanabe | 346/140 |
| 4,682,184 | 7/1987 | Terasawa | 346/140 R |
| 4,728,970 | 3/1988 | Terasawa | 346/140 R |
| 4,739,340 | 4/1988 | Terasawa | 346/1.1 |
| 4,745,414 | 5/1988 | Okamura et al. | 346/140 R |

FOREIGN PATENT DOCUMENTS

| | | |
|---|---|---|
| 2356171 | 6/1974 | Fed. Rep. of Germany . |
| 3316968 | 11/1983 | Fed. Rep. of Germany . |
| 3503080 | 8/1985 | Fed. Rep. of Germany . |

*Primary Examiner*—Joseph W. Hartary

*Attorney, Agent, or Firm*—Fitzpatrick, Cella, Harper & Scinto

[57] ABSTRACT

An ink jet recovery device comprises an elastic cap that is movable between a retracted position, in which it is spaced from a recording head, and a contact position, in which it is pressed against and seals the recording head. The recovery device also includes a rotatable drive gear having a cam surface, with a retracting cam and a compression cam, for moving the cap. When the drive gear is in a first angular position the retracting cam moves the cap to its retracted position, and when the drive gear is in a second angular position the compression cam presses the cap against the recording head. The drive gear has a third angular position for disengaging the pin from the cam surface so that a spring can press the cap into the contact position. In operation, the compression cam further presses the cap toward the recording in order to force air into the recording head to aid recovery.

6 Claims, 7 Drawing Sheets

INK JET RECOVERY DEVICE HAVING A SPRING-LOADED CAP AND A MECHANISM FOR PRESSING THE CAP AGAINST A RECORDING HEAD AND APPARATUS INCORPORATING THE DEVICE

This application is a continuation of application Ser. No. 07/077,879 filed July 27, 1987, now abandoned.

BACKGROUND OF THE INVENTION

1. Field of the Invention

This invention relates to an ink jet recovery device from recovering from unsatisfactory discharge including the ink non-discharge of an ink jet recording head, and an ink jet recording apparatus having such ink jet recovery device.

2. Related Background Art

In ink jet recording apparatuses, to prevent the clogging of ink discharge ports provided in the recording head or the mixing of air from the ink discharge ports from causing unsatisfactory discharge of ink, there is in some cases provided an ink recovery device for sucking ink from the ink discharge ports and thereby normalizing the ink discharge state.

The conventional ink recovery device of this type, however, has suffered from a problem that for the unsatisfactory discharge caused by the mixing of air in the recording head, only the ink is sucked and the air particularly at the corner or the stepped portion in the recording head is not sucked and discharged and the discharge state remains unstable.

In FIG. 1 of the accompanying drawings, there is shown the construction of the conventional ink recovery device. A plurality of discharge ports 1E in a recording head 1 are hermetically sealed by a cap 3 to which are connected a suction tube 4 and an atmosphere-open tube 5. The other end of the suction tube 4 is connected to a suction pump 6 which is a negative pressure generating source. The atmosphere-open tube 5 is provided with a vent valve 7 and an electromagnetic valve 8, the opening and closing of which is controlled by an electromagnetic valve opening-closing control timer 9. An ink absorbing member 2 capable of absorbing and retaining ink is provided in the cap 3. The vent valve 7 is operatively associated with the operating lever of the suction pump 6, and is adapted to be closed during ink suction and to be opened during the capping for preventing the evaporation of ink in the ink discharge ports and the adherence of dust to the ink discharge ports. The electromagnetic valve 8 is normally closed, but may be opened by the electromagnetic valve opening-closing control timer 9 at a timing which will be described later to thereby communicate the atmosphere-open tube 5 with the atomsphere.

The operation of the above-described ink recovery device will hereinafter be described with reference to the timing chart of FIG. 2 of the accompanying drawings.

When the suction pump 6 is turned ON (operative state) at a point of time t0 in FIG. 2 with the discharge ports 1E hermetically sealed by the cap 3 and with the vent valve 7 and the electromagnetic valve 8 closed, air is sucked in through the suction tube 4 and negative pressure (for sucking the ink) is produced in the cap 3 and in the atmosphere-open tube 5 and thus, the ink is sucked in from the discharge ports 1E. The ink thus sucked in fills the cap 3 and overflows from the ink absorbing member 2. In some cases, the atmosphere-open tube 5 is also filled with the ink. However, this state, if continued, will adversely affect the ink discharge thereafter. So, at a point of time t1 in a predetermined time after the point of time t0, the electromagnetic valve 8 is turned ON (opened state) to thereby communicate the atmosphere-open tube 5 with the atmosphere. Thereupon, the ink overflowing from the ink absorbing member 2 and the ink in the atmosphere-open tube 5 are sent to the suction pump 6 through the suction tube 4.

As shown in FIG. 2, the pressure in the cap 3 (the suction pressure waveform) becomes negative pressure with some rising angle at the point of time t0 whereat the suction pump 6 has been turned ON, and abruptly restores the atmospheric pressure at the point of time t1 whereat the electromagnetic valve 8 has been turned ON (opened). Accordingly, after the point of time t1, ink suction does not take place. The time t1–t0 from the point of time t0 at which the suction pump 6 is turned ON till the point of time t1 at which the electromagnetic valve 8 is turned ON is controlled by the electromagnetic valve opening-closing control timer 9. Also, this time t1–t0, i.e., the ink suction time, can be varied by adjusting the electromagnetic valve opening-closing control timer 9.

Heretofore, unsatisfactory discharge has been eliminated by the negative pressure suction sequence of FIG. 2. However, particularly when bubbles 1C are present in the common ink chamber 1B rearward of the liquid path 1A of the recording head 1 as shown in FIG. 1, unsatisfactory discharge has been liable to occur and recovery has been difficult. Also, when bubbles are present in the corner and stepped portion in the common ink chamber 1B, even if the ink is sucked by the negative pressure of the suction pump 6, the ink has flowed toward the discharge ports 1E only in the portion of the interior of the common ink chamber 1B through which the ink is ready to flow and the bubbles 1C have remained stagnant and as a result, unsatisfactory discharge has been difficult to eliminate.

SUMMARY OF THE INVENTION

It is an object of the present invention to overcome the above-noted disadvantage peculiar to the prior art that unsatisfactory discharge has sometimes been difficult to eliminate and to provide an ink jet recovery device which can easily accomplish removal of bubbles stagnant in the recording head, and an ink jet recording apparatus having such ink jet recovery device.

It is also an object of the present invention to provide an ink jet recovery device characterized by a cap for hermetically sealing the discharge port of an ink jet recording head, first means for imparting a predetermined hermetically sealing force to said cap, and second means for imparting to said cap a stronger hermetically sealing force as compared with said predetermined hermetically sealing force imparted by said first means, and an ink jet recording apparatus having such ink jet recovery device.

DESCRIPTION OF THE PREFERRED EMBODIMENT

When an elastic cap 3 is forcibly moved back and forth with a vent valve and an electromagnetic valve closed, the air in the cap is pressurized and enters a common ink chamber and also a part of a head supply pipe. When in this state, the air is sucked in by negative pressure by means of a suction pump, the air is discharged at a stroke from a discharge port, and the head supply pipe, the common ink chamber and a liquid path are filled with ink, whereby stability of the ink discharge of a recording head 1 can be achieved.

An embodiment of the present invention will hereinafter be described in detail with reference to the drawings.

Figure 3:
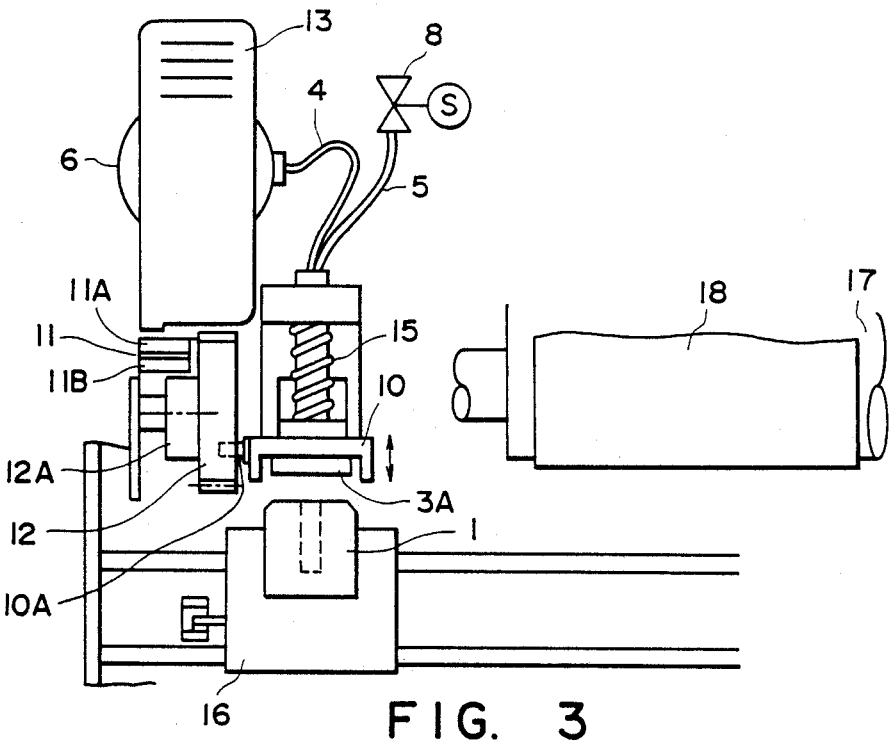
FIG. 3 is a schematic plane view illustrating the construction of the ink jet recording apparatus of the present invention.
Figure 4:
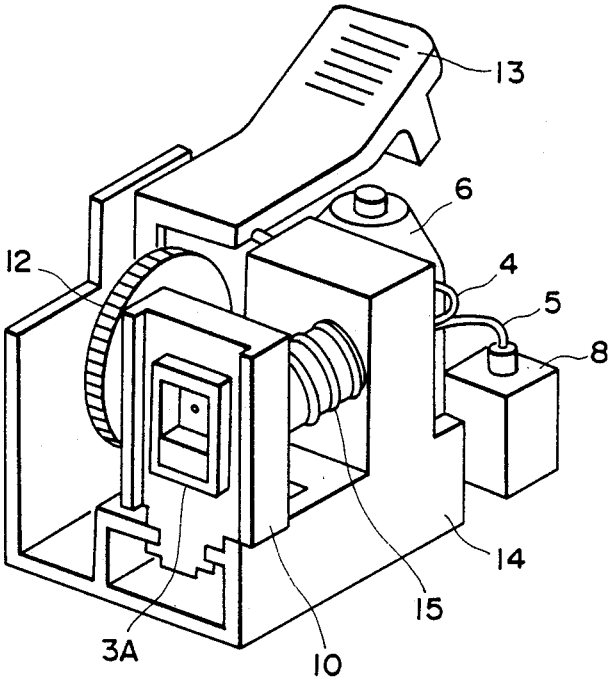
FIG. 4 is a schematic perspective view of an embodiment of the ink jet recovery device of the present invention.

FIG. 3 shows a schematic top plan view of an embodiment of an ink jet recording apparatus having the ink jet recovery device of the present invention, and FIG. 4 shows a schematic perspective view of an embodiment of the ink jet recovery device of the present invention.

Figure 1:
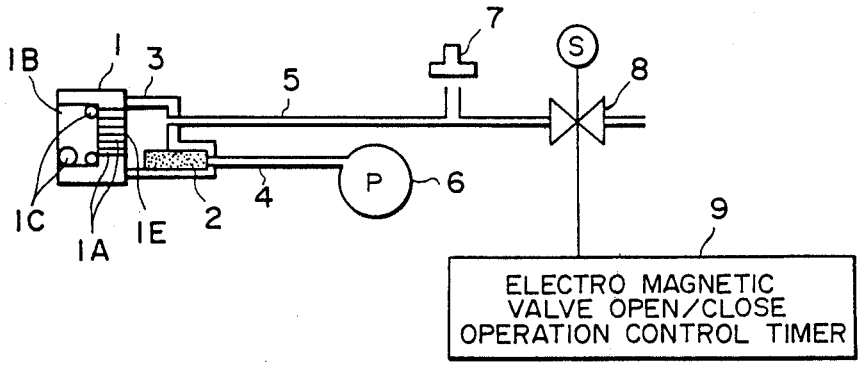
FIG. 1 PRIOR ART
FIG. 1 is a schematic view showing the construction of an ink recovery device according to the prior art.

In FIGS. 3 and 4, the same portions as those in FIG. 1 are given the same reference numerals and need not be described. Designated by 3A is an elastic cap capable of hermetically sealing the recording head 1 and formed of rubber, butyl rubber or other suitable material of elasticity. Reference numeral 10 denotes a cap holder containing the cap 3A therein, reference numeral 11 designates a contact, and reference numeral 12 denotes a drive gear connected to a motor, not shown. Reference numeral 13 designates a pump lever, reference numeral 14 denotes a base, and reference numeral 15 designates a spring or elastic pressing member which applies a predetermined sealing force to the cap and biases the cap 3A forwardly. Reference numeral 16 denotes a carriage, reference numeral 17 designates a platen, and reference numeral 18 denotes recording paper.

With the revolution of a motor (not shown) by the command of a controller such as a microprocessor contained in the body of the ink jet recording apparatus, the gear 12 rotates to reciprocate the cap holder 10 containing the cap 3A therein and urge the cap 3A against the recording head 1 of the carriage and space it apart from the recording head. The opened retracted and closed (contact) states or positions of the cap 3A can be detected by closing the cap contact 11B of the contact 11 by means of the positioning cam 12A of the gear 12, and the result of the detection is input to the aforementioned controller. Detection of the ON and OFF of the suction pump 6 is accomplished by opening and closing the pump contact 11A of the contact 11 by means of an end of the pump lever 13. The cap 3A is fixed integrally to the cap holder 12. The sealing force of the recording head 1 is created by providing a thrust to the cap holder 10 guided by the base 14, by means of the spring 15 attached to the base 14. Since the recording head and the base are installed in a predetermined positional relation, the sealing force is constant.

Figure 5:
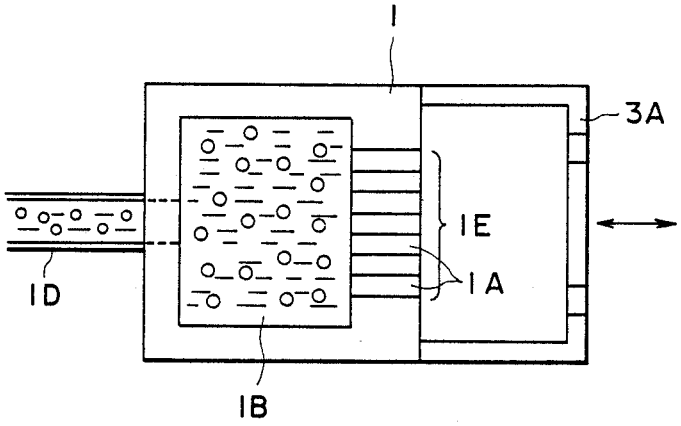
FIG. 5 is a schematic cross-sectional view of a recording head and a cap.

When the cap 3A is forcibly moved back and forth as indicated by the arrow in FIG. 5 with the vent valve 7 and the electromagnetic valve 8 closed, the air in the cap 3A is pressurized and enters the common ink chamber 1B and also a part of the head supply pipe 1D. When in this state, the air is sucked in by negative pressure by means of the suction pump 6, the air is discharged at a stroke from the discharge port, and the head supply pipe 1D, the common ink chamber 1B and the liquid path 1A are filled with ink, whereby stability of the ink discharge of the recording head 1 is achieved. This is because the air is finely replaced by the ink.

Figure 6:
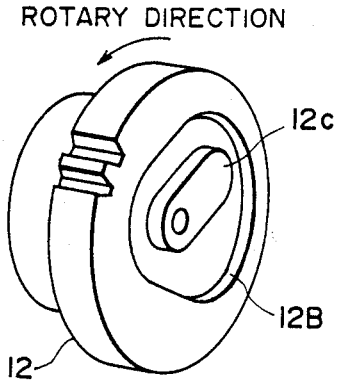
FIG. 6 is a schematic perspective view of a gear in the embodiment of the present invention.
Figure 7:
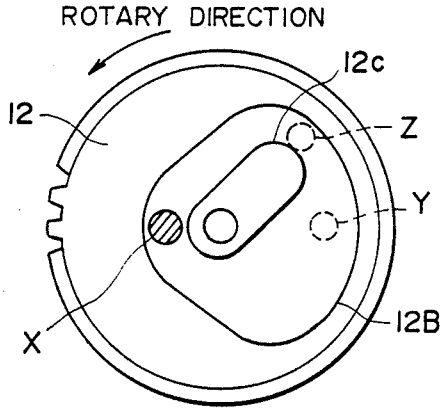
FIG. 7 is a schematic cross-sectional view of the gear.

FIGS. 6 and 7 show the details of the gear 12. FIG. 6 is a schematic perspective view of the gear 12 and its cam surface, and FIG. 7 is a schematic cross-sectional view thereof. With rotation of the gear 12, a cap holder pin or drive member 10A is moved back and forth in an inner face or retracting cam 12B provided in the gear 12. When the gear 12 is in a first angular position, the cap holder pin 10A is in a position X indicated in FIG. 7, and the cap 3A is open. When the gear 12 is in another angular position, the pin 10A is in a position Y indicated in FIG. 7, which is the closed position of the cap. At this time, the cap 3A bears against the discharge port surface of the recording head 1 and is pressed against the discharge port surface of the recording head 1 with a predetermined pressure or hermetically sealing force by the spring 15. During transportation or the like, the cap may be left in such closed position for a long time and therefore, in such position a great compressive force cannot be imparted in order to prevent plastic deformation of the cap. When the gear 12 is in yet another angular position, the cap holder pin 10A shifts to a position Z as indicated in FIG. 7, and a compression cam 12C, which applies a stronger sealing force to the cap, further pushes or presses the cap holder pin 10A. Therefore, in addition to the spring force of the spring 15, a mechanical compressive force is imparted to the cap 3A pressed against the recording head 1 by the force of the spring 15. Thus, a great compressive force is, momentarily imparted to the cap 3A when it shifts from its opened state to its closed state. By doing so, the amount of compression than the predetermined sealing force of the cap 3A can be made greater and therefore, the air can be readily caused to enter the recording head. Accordingly, when the drive gear is in a first angular position (pin position X), the cap member is held in its retracted position by the retracting cam, and when the drive gear is in a second angular position (pin position Z), the cap is pressed against the head by the compression cam. When the drive gear is in a third angular position (pin position Y), the pin is disengaged from the cam surface and the spring presses the cap member against the head.

The drive gear and its associated structure thus comprise a control mechanism for causing the cap to move sequentially from the retracted position to the contact position having the spring pressing the cap against the recording head and back to the retracted position. The compression cam comprises means for further pressing the cap toward the head as the cap is moved to the spring-urged contact position from the retracted position.

Figure 8A:
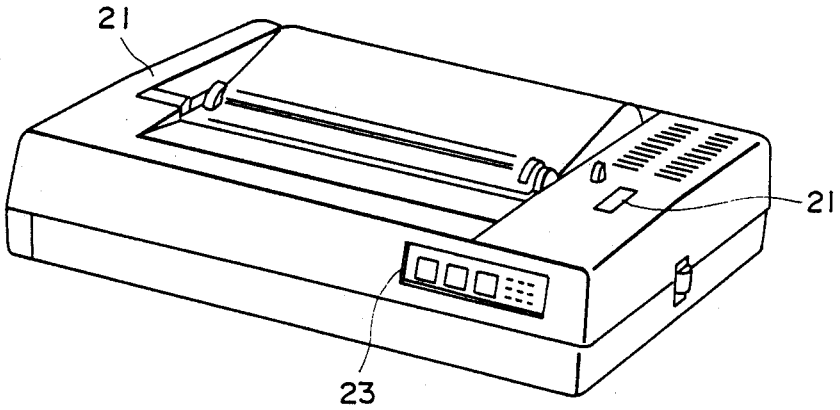
FIG. 8(A) is a schematic perspective view of an ink jet recording apparatus.
Figure 8B:
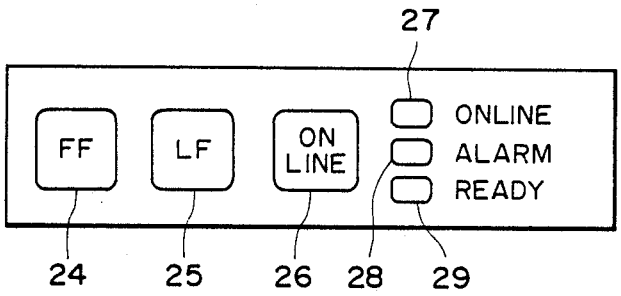
FIG. 8(B) is a schematic front view of the operating panel of the ink jet recording apparatus.

FIGS. 8A and 8B show the appearance of an ink jet recording apparatus to which the present invention is applicable and an example of the construction of an operating panel provided on the front face of the apparatus. In FIG. 8A, reference numeral 21 designates the apparatus body, reference numeral 22 denotes a main switch, and reference numeral 23 designates an operating panel. On the operating panel 23, as shown in FIG. 8B, there may be provided command means such as an FF (form feed) switch 24 for the operator to command conveyance of a recording medium such as paper, an LF (line feed) switch 25 and an on line switch 26 for giving, for example, an on line command with a master device, and in addition, display means such as an on line lamp 27 for displaying the on line state of the apparatus, an alarm lamp 28 for informing the operator of abnormality or the like and a ready lamp 29 for informing the operator of a ready state.

Figure 9:
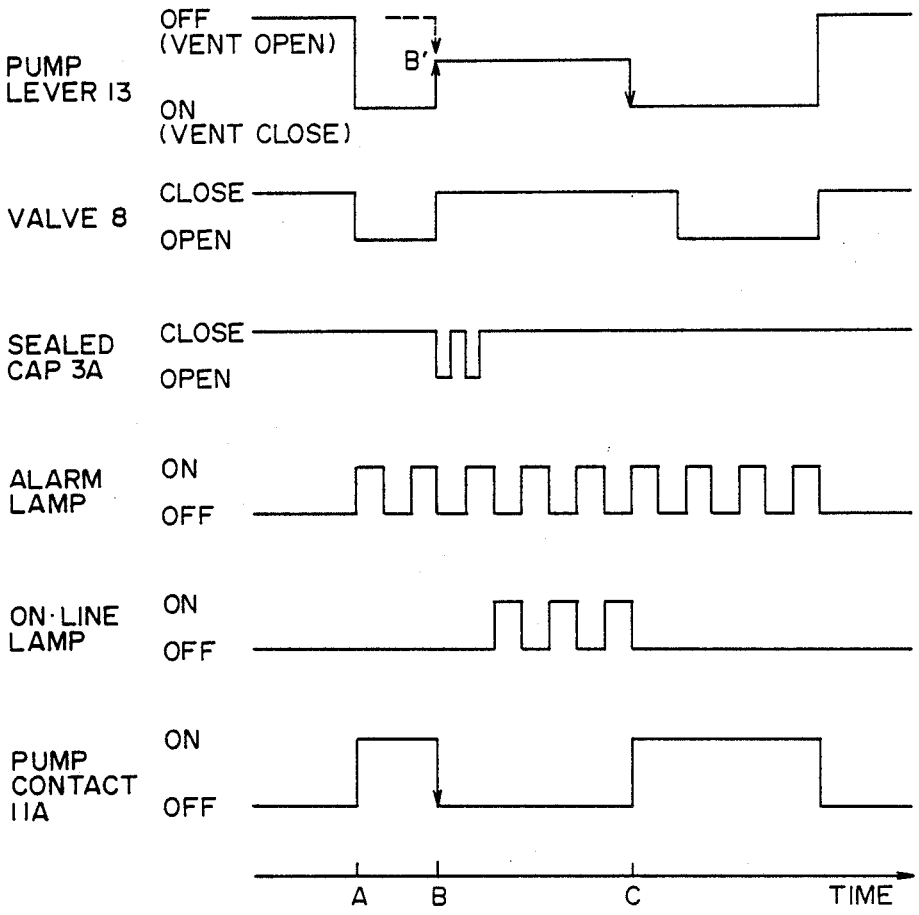
FIGS. 9 and 10 timing charts illustrating the recovering operation of the present invention.

FIG. 9 shows a timing chart of the recovery operation. When the pump lever 13 is pushed in at a point of time A, the vent valve 7 operatively associated with the lever 13 is closed and the pump contact 11A makes. Thereupon, the controller opens the electromagnetic valve 8 and operates the pump 6. At this time, the cap 3A closes the recording head 1. The alarm lamp is turned on and off to indicate that the recovery operation is going on. Even if the suction pump 6 is operated, no negative pressure will be produced because the electromagnetic valve 8 is opened to the atmosphere.

When the push-in of the pump lever 13 is stopped at a point of time B, the pump lever 13 is moved up as indicated by B' by a spring, not shown, in the pump, and the pump contact 11A shifts from its ON state to its OFF state. When the OFF state of the pump contact 11A is detected, the controller closes the electromagnetic valve 8 and drives the gear 12 to effect the opening and closing of the cap 3A. As previously described, with such opening and closing of the cap 3A, a compressive force is further applied to the elastic cap 3A in its state urged against the recording head 1 and therefore, the air enters the recording head. After one to two opening-closing operations at the point of time B, the turn-on-and-off of the lamp changes from the turn-on-and-off of the alarm lamp to the mutual turn-on-and-off of the alarm lamp and the on line lamp, thereby demanding the second pump lever operation C for sucking and recovering the negative pressure from the recording head.

Figure 2:
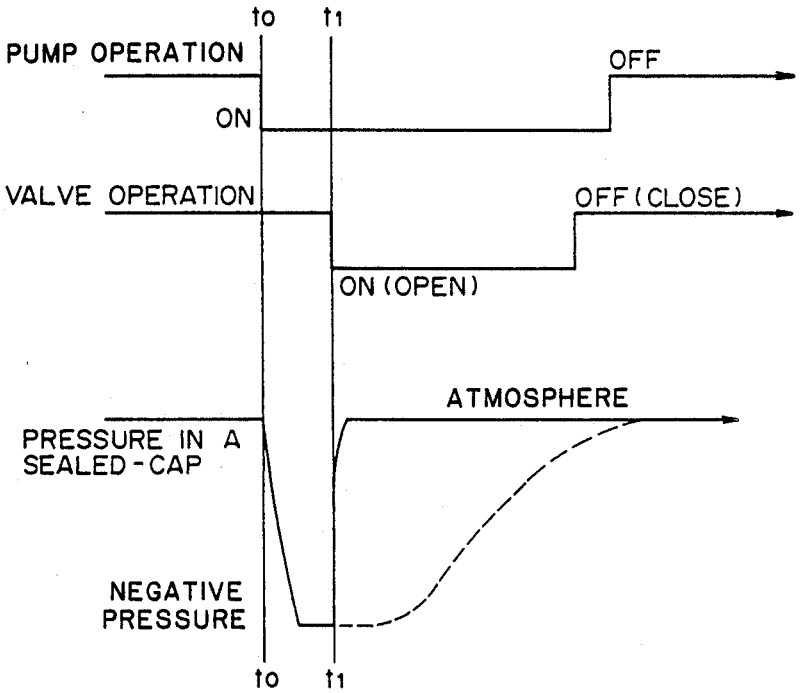
FIG. 2 PRIOR ART
FIG. 2 is a timing chart of the conventional recovering operation.

The operations after the operation C are similar to those in the timing chart shown in FIG. 2. The turn-on-and-off of the on line lamp is interrupted and the alarm lamp is turned on and off for a predetermined time, whereafter the pump lever 13 is raised up and the recovery operation is terminated.

Figure 10:
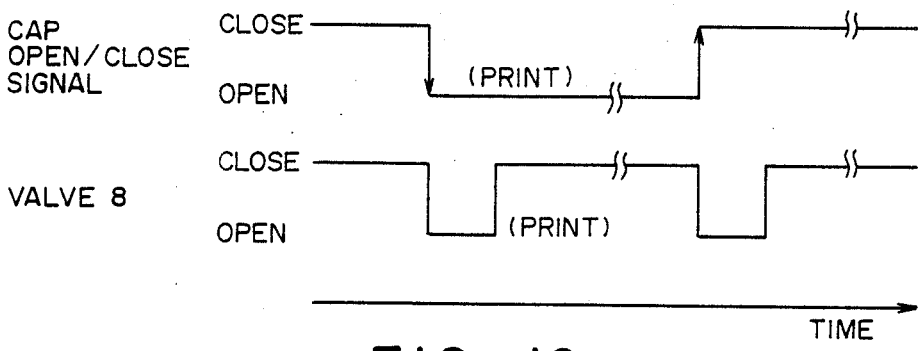

FIG. 10 shows the time chart of a normal capping operation. The electromagnetic valve 8 is opened to the atmosphere for a predetermined time in response to the cap opening-closing signal by the contact 11B so that the air may not enter the recording head even if the operator forgets to raise up the pump lever in the closed state of the cap 3A.

As shown in FIG. 9, the ink suction at a point of time C is effected after the opening and closing of the cap at the point of time B and therefore, small bubbles can be prevented from stagnating in the printing head. Although description has been made of an example in which the pump lever operation is manually effected, it is very easy to automate the same and the FF, LF and ON LINE switches on the operating panel 23 of the ink jet recording apparatus can be utilized to operate the recovery device as shown in the timing chart of FIG. 9.

Figure 11:
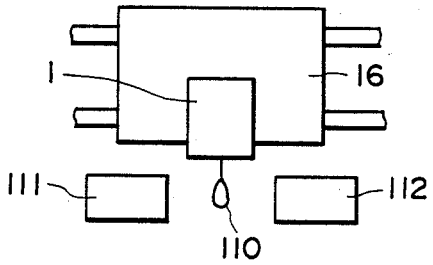
FIGS. 11 and 12 are a schematic top plan view and a schematic perspective view, respectively, showing the essential poritons of an ink jet recording apparatus having means for checking up the ink discharge state.
Figure 12:
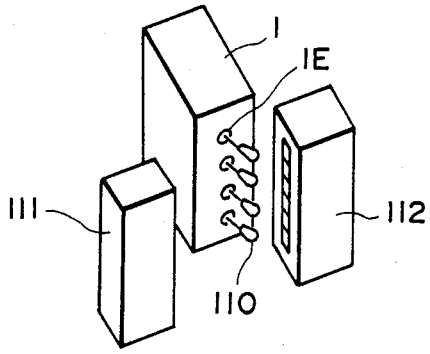

FIGS. 11 and 12 are a schematic top plan view and a schematic perspective view, respectively, showing the essential portions of an ink jet recording apparatus having means for checking up the ink discharge state. In FIGS. 11 and 12, reference numeral 111 designate light-emitting means such as an LED, and reference numeral 112 denotes light-receiving means having a photosensor array such as a CCD. Liquid droplets 110 discharged and flying from the discharge ports 1E of the recording head 1 are checked up by the light-emitting means 111 and light-receiving means 112 to thereby check up the ink discharge state, whereafter in accordance with the flow chart shown in FIG. 13, the aforedescribed recovery operation is performed as required.

Further, a start switch or the like may be provided so that also in a manual operation, start may be made from the dotted line at the point of time B in the timing chart of FIG. 9, whereby the recovery operation can be simplified.

According to the above-described embodiment, the pump lever and the electromagnetic valve are operated to control the opening and closing of the cap by the spring force and the compelling force, whereby the bubbles, for example, at the corner or the stepped portion in the recording head which are difficult to discharge can be made into large lamps of air and easily discharged from within the recording head during negative pressure suction to thereby recover from unsatisfactory discharge.

As is apparent from the foregoing description, according to the present invention, there can be provided an ink jet recovery device in an ink jet recording apparatus which can easily remove any bubbles stagnating in the recording head during ink suction, as well as an ink jet recording apparatus having such ink jet recovery device.

We claim:

1. An ink jet recovery device comprising:

a cap member for sealing an ink jet recording head:

an elastic pressing member for urging said cap member toward the recording head, said cap member being movable between a retracted position wherein said cap member is spaced from the recording head and a contact position wherein said cap member is pressed against and seals the recording head;

a guide member on said cap member for transmitting thereto a drive force for moving said cap member; and a rotatable drive gear having a cam surface including a retracting cam for engaging said guide member to place said cap member in the retracted position when said drive gear is in a first angular position and a compression cam for engaging said guide member to press said cap member against the recording head when said drive gear is in a second angular position, wherein said drive gear has a third angular position for disengaging said guide member from said cam surface so that said elastic pressing member can press said cap member into the contact position, said compression cam further pressing said cap member toward the recording head in order to force air into the recording head.

2. An ink jet recovery device according to claim 1, wherein said drive gear is flat and has gear teeth around the periphery thereof, said cam surface is formed in a face of said drive gear and said guide member comprises a pin projecting from said cap member for engaging said cams.

3. An ink jet recovery device according to claim 1, further including a valve mechanism for closing the interior of said cap member to the atmosphere when said drive gear is in the second angular position and a suction pump for applying negative pressure to the interior of said cap member.

4. An ink jet recording apparatus having an ink jet recording head, the apparatus comprising:

a recovery device including an elastic cap member for sealing said recording head and an elastic pressing member for urging said cap member toward said recording head, said cap member being movable between a retracted position wherein said cap member is spaced from the recording head and a contact position wherein said cap member is pressed against and seals the recording head; and a control mechanism for causing said cap member to move sequentially from the retracted position to the contact position having said elastic pressing member pressing said cap member against the recording head and then back to the retracted position, said control mechanism including means for further pressing said cap member toward said recording head in order to force air into the recording head as said control mechanism causes said cap member to move to the contact position from the retracted position.

5. An ink jet recording apparatus according to claim 4, wherein:

said recovery device further includes a guide member on said cap member for transmitting thereto a drive force for moving said cap member; and said control mechanism comprises a rotatable drive gear including a cam surface for moving said cap member to the retracted position and for further pressing said cap member toward said recording head.

6. An ink jet recording apparatus according to claim 4, further including a valve mechanism for closing the interior of said cap member to the atmosphere when said cap member is pressed further toward said recording head and a suction pump for applying negative pressure to the interior of said cap member.

* * * * *

UNITED STATES PATENT AND TRADEMARK OFFICE

CERTIFICATE OF CORRECTION

PATENT NO. : 4,970,534

DATED : November 13, 1990

INVENTOR(S) : KOJI TERASAWA ET AL.

It is certified that error appears in the above-identified patent and that said Letters Patent is hereby corrected as shown below: TITLE PAGE:

AT [56] REFERENCES CITED

Under U.S. Patent Documents, add
--4,819,012 4/1989 Kiyohara et al....346/140R-- .
Under Foreign Patent Documents, add
--57-117964 7/1982 Japan--.

AT [63] Related U.S. Application Data

"Continuation of Ser. No. 77,879, Jul. 27, 1989."
should read
-- Continuation of Ser. No. 77,879, Jul. 27, 1987.--.

AT [57] ABSTRACT

Line 16, "ing" should read --ing head--.

SHEET 7 OF 7

Figure 13:
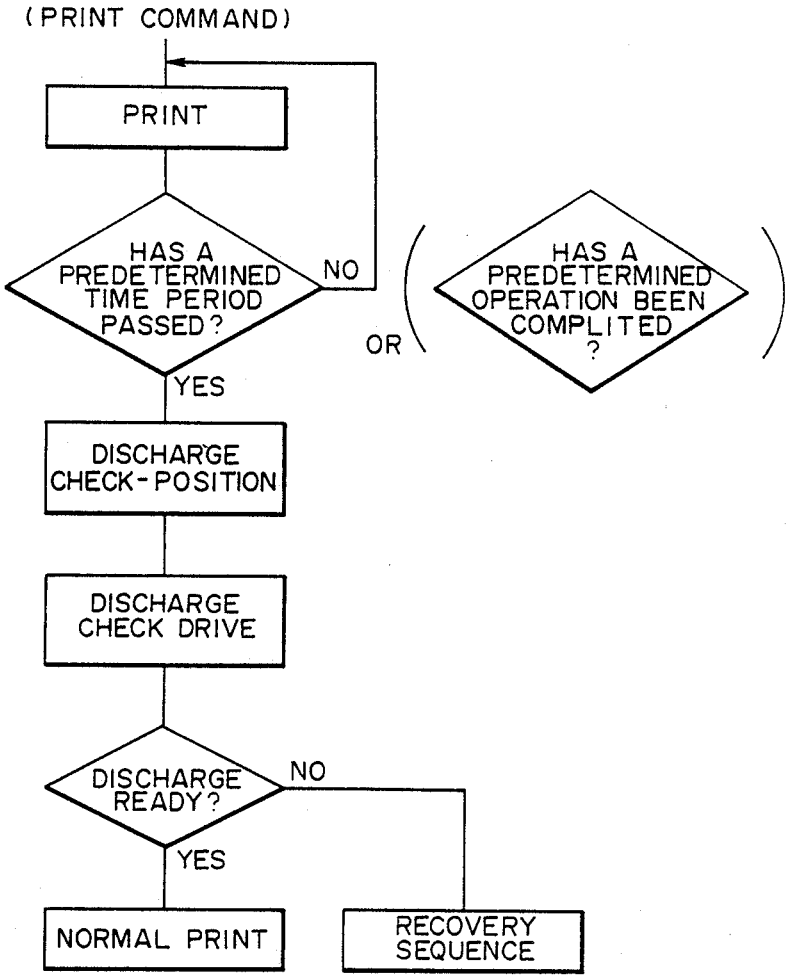
FIG. 13 is a flow chart when check-up of the ink discharge state is effected.

FIG. 13, "COMPLITED" should read --COMPLETED--.

COLUMN 1

Line 55, "atomsphere." should read --atmosphere.--.

COLUMN 2

Line 4, "in" should be deleted.

COLUMN 3

Line 20, "poritons" should read --portions--.
Line 66, "retracted" should read --(retracted)--.

UNITED STATES PATENT AND TRADEMARK OFFICE

CERTIFICATE OF CORRECTION

PATENT NO. : 4,970,534

DATED : November 13, 1990

INVENTOR(S) : KOJI TERASAWA ET AL.

It is certified that error appears in the above-identified patent and that said Letters Patent is hereby corrected as shown below:

COLUMN 4

Line 55, "is," should read --is--.
Line 57, "compression than" should read --compression or hermetically sealing force of the cap 3A can be made greater than--.
Line 58, "of the cap 3A can be made greater" should be deleted.

COLUMN 5

Line 31, "makes." should read --closes.--.

COLUMN 6

Line 17, "designate" should read --designates--.
Line 38, "lamps" should read --clumps--.

Signed and Sealed this

Twenty-eighth Day of July, 1992

*Attest:*

DOUGLAS B. COMER

*Attesting Officer*

*Acting Commissioner of Patents and Trademarks*